US005791177A

United States Patent [19]

Bianco

[11] Patent Number: 5,791,177

[45] Date of Patent: Aug. 11, 1998

[54] COMPACT ELECTRONIC LOCK

[76] Inventor: James S. Bianco, 217 Brainard Rd., Enfield, Conn. 06082

[21] Appl. No.: 574,276

[22] Filed: Dec. 18, 1995

Related U.S. Application Data

[63] Continuation-in-part of Ser. No. 510,486, Aug. 2, 1995, which is a continuation-in-part of Ser. No. 395,417, Feb. 27, 1995, Ser. No. 985,840, Dec. 3, 1992, abandoned, Ser. No. 921,418, Jul. 27, 1992, abandoned, and Ser. No. 780,155, Oct. 21, 1991, abandoned.

[51] Int. Cl.[6] ..... E05B 49/02

[52] U.S. Cl. ..... 70/278; 70/189; 70/223; 70/283; 70/379 R; 70/422; 70/472

[58] Field of Search ..... 70/277–283, 472, 70/217, 222, 223, 422, 218, 188, 189, 231, DIG. 42, 379 R, 379 A, 380

[56] References Cited

U.S. PATENT DOCUMENTS

| | | | |
|---|---|---|---|
| 1,776,881 | 9/1930 | Birdsall | 70/380 |
| 2,105,304 | 1/1938 | Wagner | 70/493 X |
| 2,475,220 | 7/1949 | Chaulk et al. | 70/283 |
| 3,512,381 | 5/1970 | Matsunaga | 70/380 |
| 3,748,878 | 7/1973 | Balzano et al. | 70/277 X |
| 4,167,104 | 9/1979 | Bond | 70/282 X |
| 4,663,953 | 5/1987 | Fish et al. | 70/380 |
| 4,712,398 | 12/1987 | Clarkson et al. | 70/283 X |
| 4,899,561 | 2/1990 | Myers | 70/379 R X |
| 5,337,588 | 8/1994 | Chhatwal | 70/283 X |
| 5,423,198 | 6/1995 | DiVito et al. | 70/283 X |
| 5,507,162 | 4/1996 | Chhatwal | 70/283 X |

FOREIGN PATENT DOCUMENTS

| | | | |
|---|---|---|---|
| 0243586 | 11/1987 | European Pat. Off. . | |
| 0401647 | 12/1990 | European Pat. Off. . | |
| 2178476 | 2/1987 | United Kingdom | 70/278 |
| 2225371 | 5/1990 | United Kingdom . | |

*Primary Examiner*—Lloyd A. Gall
*Attorney, Agent, or Firm*—John H. Crozier

[57] ABSTRACT

An electronic cylinder lock, including: a generally cylindrical housing having substantially open and closed ends; a barrel member coaxial with and rotatable within the generally cylindrical housing and having receiving apparatus defined at a first end thereof for the insertion into the receiving apparatus of key apparatus, engagement of the receiving apparatus and the key apparatus permitting the barrel member to be manually rotated; shaft apparatus coaxial with the generally cylindrical housing and extending through an opening defined through the substantially closed end, the shaft apparatus having a head end disposed within the generally cylindrical housing and a threaded end extending externally from the substantially closed end for the attachment to the threaded end of locking/unlocking apparatus; a bar at least partially disposed within the head end such that rotation of the bar causes rotation of the shaft apparatus, the bar being axially moveable within the generally cylindrical housing, and the bar being selectively engageable with a second end of the barrel member such that rotation of the barrel member causes rotation of the bar; and apparatus to cause the bar to be disengaged from the second end of the barrel member when the electronic cylinder lock is in a locked position and to cause the bar to be engaged with the second end of the barrel member to permit the receiving apparatus, the barrel member, the bar, and the shaft apparatus to rotate by rotation of the key apparatus to permit the electronic lock to be unlocked.

5 Claims, 10 Drawing Sheets

COMPACT ELECTRONIC LOCK

CROSS-REFERENCE TO RELATED APPLICATIONS

The present application is a continuation-in-part of co-pending application Ser. No. 08/510.486, filed Aug. 2, 1995, which is a continuation-in-part of co-pending application Ser. No. 08/395.417, filed Feb. 27, 1995, which is a continuation-in-part of application Ser. No. 07/985.840, filed Dec. 3, 1992, abandoned, which is a continuation-in-part of application Ser. No. 07/921.418, filed Jul. 27, 1992, abandoned, which is a continuation-in-part of application Ser. No. 07/780.155, filed Oct. 21, 1991, abandoned, the disclosures of which are incorporated by reference hereinto.

BACKGROUND OF THE INVENTION

1. Field of the Invention

The present invention relates to lock systems generally and, more particularly, but not by way of limitation, to a novel electronic lock system which is especially useful in monitoring use of the lock.

2. Background Art

In many situations, it would be desirable to have a record of who opened a lock, when the lock was opened, and for how long the lock was opened. One such situation, for example, is access to slot machine mechanisms. Another such situation is access to vending machines.

Accordingly, it is a principal object of the present invention to provide a lock system which is capable of monitoring use of a lock.

It is a further object of the invention to provide such a lock system which can record who opened a lock, when the lock was opened, and for how long the lock was opened.

It is an additional object of the invention to provide such a lock system that is compact and can be easily retrofitted to systems in which mechanical key locks are employed.

It is another object of the invention to provide such a lock system which is economical to construct.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, an electronic cylinder lock, comprising: a generally cylindrical housing having substantially open and closed ends; a barrel member coaxial with and rotatable within said generally cylindrical housing and having receiving means defined at a first end thereof and disposed at said substantially open end for the insertion into said receiving means of key means, engagement of said receiving means and said key means permitting said barrel member to be manually rotated; shaft means coaxial with said generally cylindrical housing and extending through an opening defined through said substantially closed end, said shaft means having a head end disposed within said generally cylindrical housing and a threaded end extending externally from said substantially closed end for the attachment to said threaded end of locking/unlocking apparatus; a bar at least partially disposed within said head end such that rotation of said bar causes rotation of said shaft means, said bar being axially moveable within said generally cylindrical housing, and said bar being selectively engageable with a second end of said barrel member such that rotation of said barrel member causes rotation of said bar; and means to cause said bar to be disengaged from said second end of said barrel member when said electronic cylinder lock is in a locked position and to cause said bar to be engaged with said second end of said barrel member to permit said receiving means, said barrel member, said bar, and said shaft means to rotate by rotation of said key means to permit said electronic lock to be unlocked.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
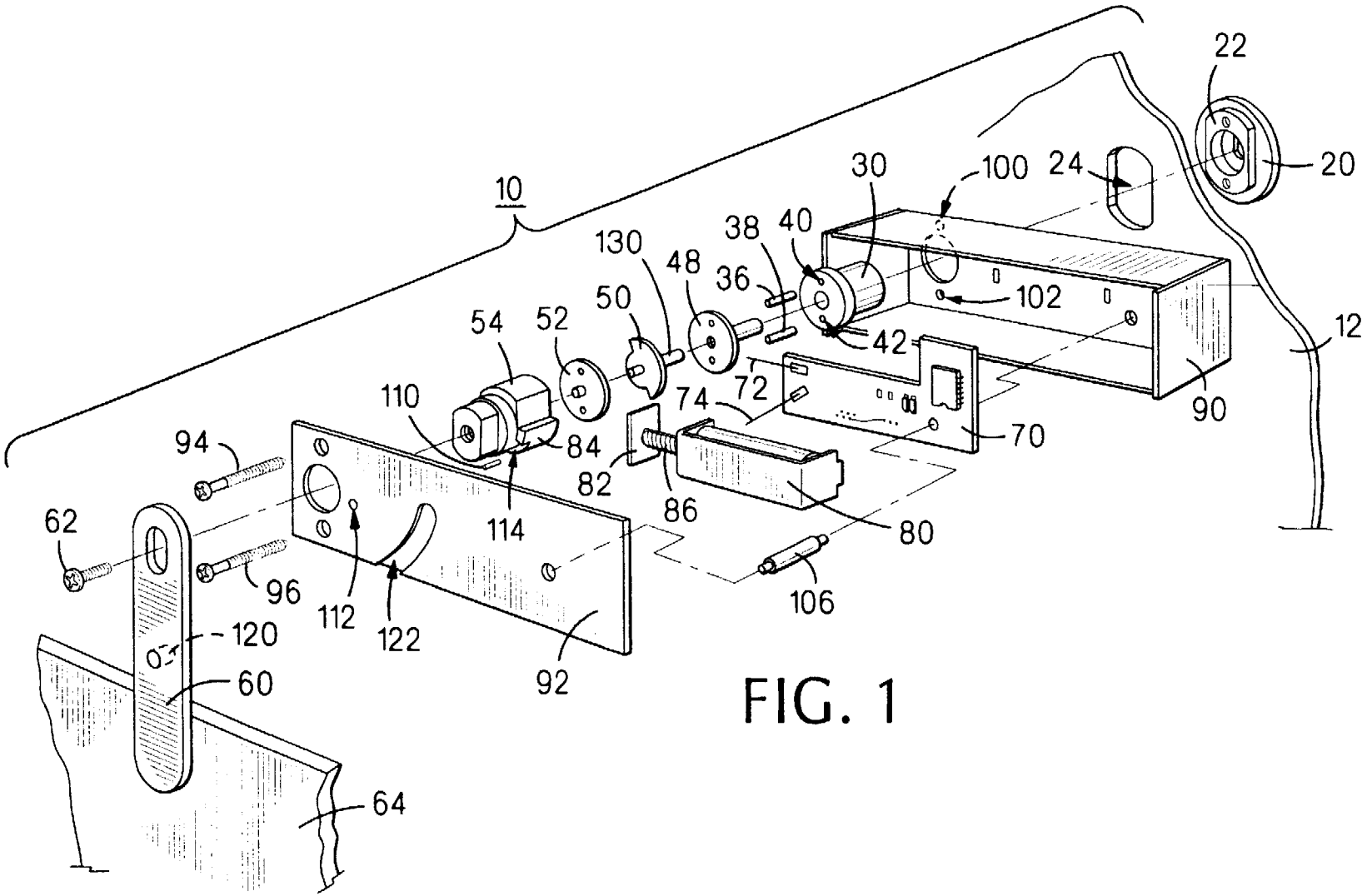
FIG. 1 is an exploded perspective view, partially cutaway, of an electronic lock constructed according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates an electronic lock constructed according to the present invention, generally indicated by the reference numeral 10, mounted, for example, to an existing cabinet door 12.

Lock 10 includes a face cover 20 having an integral rearwardly extending hub 22 which hub fits into a complementarily shaped double-D opening 24 defined in cabinet door 12 to prevent the rotation of the face cover and hub relative to the cabinet door. A cylindrical drive hub 30 is inserted into and rotates within member 22. Drive hub 30 has defined in the front portion thereof an opening (not shown) to accept therein a key or wrench (not shown) which may be the oval wrench described in the above-referenced application Ser. No. 08/395,417. Two drive pins 36 and 38 inserted into holes 40 and 42 defined in the rear face of drive hub 30 attach the drive hub to, in order, a first insulator 48, a communication plate 50, a second insulator 52, and a lock hub 54. Lock hub 54 is attached to a lock bar 60 by means of a screw 62, the lock bar engaging a surface, such as surface 64, for example, to prevent cabinet door 12 from being opened.

Lock 10 further includes a printed circuit board 70 having electronic circuitry, including a microprocessor and a non-volatile memory, mounted thereon and two contact wires 72 and 74 extending therefrom. An unlock solenoid 80 includes a lock plate 82 at the end thereof which engages a step 84 formed on lock hub 54 when lock 10 is in its locked position. A spring 86 biases lock plate 82 into the locked position when unlock solenoid 80 is unenergized.

All the components of lock 10, except for lock bar 60, are disposed in a housing 90 attached to the rear surface of cabinet door 12 and having a rear cover plate 92, the components being secured together and attached to the rear surface of the cabinet door by means of two screws 94 and 96 extending through rear cover plate 92 holes 100 and 102 defined through the front of the housing and into the cabinet door. A spacer 106 extends between rear cover plate 92 and the front of housing 90.

Figure 2:
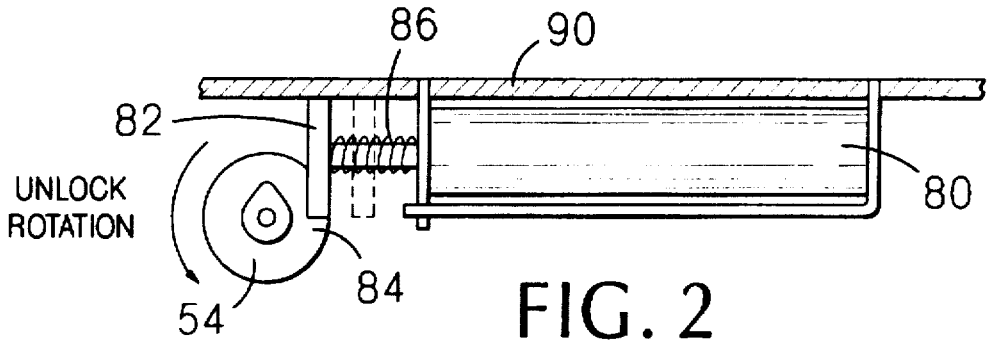
FIG. 2 is a fragmentary rear elevational view showing the latching mechanism of the electronic lock.

With reference also to FIG. 2, the action of unlock solenoid 80 is illustrated. Lock plate 82 is shown, in solid lines, engaging step 84 on lock hub 54 to prevent the rotation thereof. When unlock solenoid 80 is energized, lock plate 82 is withdrawn from engagement with step 84, as shown in broken lines, and lock hub 54 is free to rotate counterclockwise as indicated by the arrow, thus disengaging lock bar 60 (FIG. 1) from surface 64 so that cabinet door 12 may be opened.

When lock 10 is subsequently locked by rotating lock hub 54 and the other rotating members clockwise, the lock hub is stopped at its home position by means of engagement of stop plate 82 with step 84.

Figure 4:
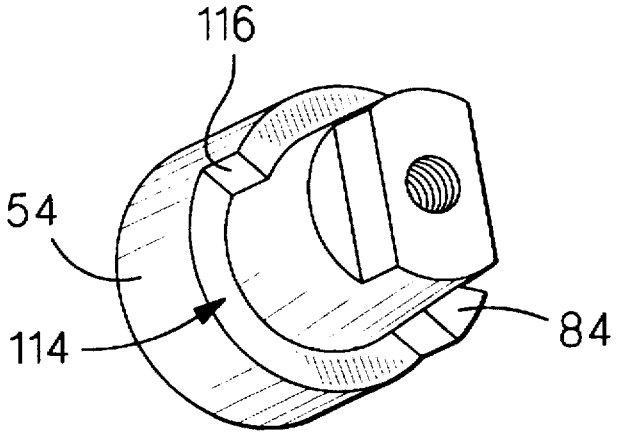
FIG. 4 is a perspective view of a component of the electronic lock.

Lock 10 is arranged so that the same components may be employed for either 90-degree or 180-degree rotation of the rotating lock members. If 90-degree rotation is desired, lock bar 60 is used in the position shown, with a stop pin 120 extending forwardly of the lock bar and engaging an arcuate channel 122 defined in the rear surface of rear cover plate 92. As lock bar 60 is rotated counterclockwise during unlocking of lock 10, stop pin 120 will enter and move within channel 122. When stop pin 120 engages the upper limit of channel 122, further counterclockwise rotation of the lock bar and the other rotating components of lock 10 past 90 degrees will be prevented. If, on the other hand, 180-degree rotation is desired, lock bar 60 is removed from lock hub 54, reversed, and reattached to the lock hub, with stop pin 120 facing rearwardly, thus permitting full rotation of the rotating members of lock 10 to the 180-degree position. The 180-degree position is determined by a rotation stop pin 110, fixed in a opening 112 defined in rear cover plate 92, engaging a channel 114 defined lock hub 54, as is more clearly shown on FIG. 4. As will be understood from FIG. 4, counterclockwise rotation of lock hub 54 will terminate when rotation stop pin 110 engages wall 116 of channel 114. The selection of degree of rotation does not have to be made until lock 10 is being installed in the field.

Lock 10 is quite compact and can be easily retrofitted to installations where mechanical key locks were previously installed.

Figure 3A:
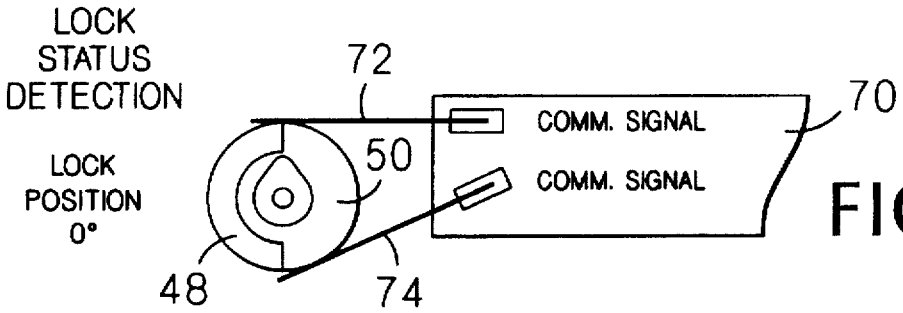
FIGS. 3A–3D are fragmentary rear elevational views showing the detection of unlocking of the lock.
Figure 3B:
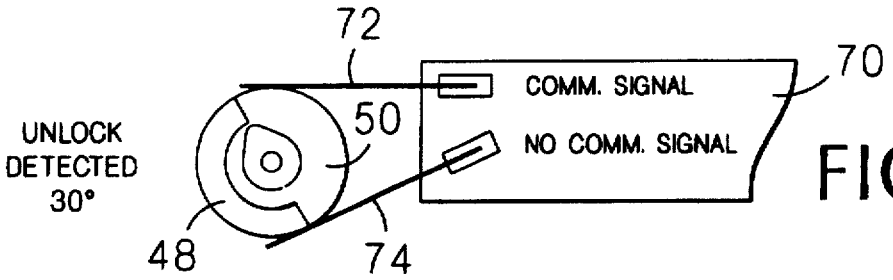
Figure 3C:
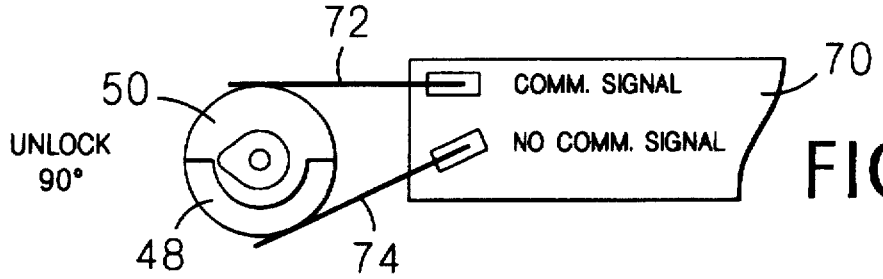
Figure 3D:
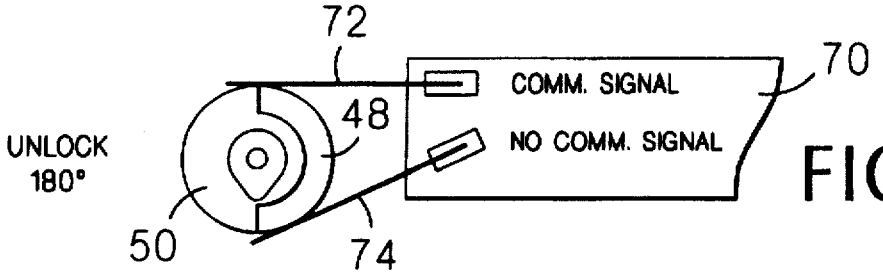

With continued reference to FIG. 1, two contact wires 72 and 74 are disposed so as to contact communication plate 50 for communication through a conductive post 130 on the communication plate, which conductive post electrically engages a contact pin on the key (not shown), as is described in the above-referenced application Ser. No. 08/395,417, for communication between the circuitry on board 70 and the key, as is also described in that application. The use of two contact wires 72 and 74 is used in the present invention to determine when lock 10 is in an unlocked position. FIG. 3A illustrates the position of communication plate 50 when lock 10 is in the locked position. Here, contact wires 72 and 74 complete an electrical path between board 70 and communication plate 50. When unlocking begins and the rotating components of lock 10 have been rotated about 30 degrees counterclockwise, as is shown on FIG. 3B, the electrical path is broken, since contact wire 74 no longer contacts communication plate 50, thus indicating an unlocked, or unlocking, condition. FIGS. 3C and 3D illustrate that no communication signal is received on contact wire 74 in either the 90-degree or 180-degree unlock positions. At all times, the communication signal is transmitted on contact wire 72.

Figure 5A:
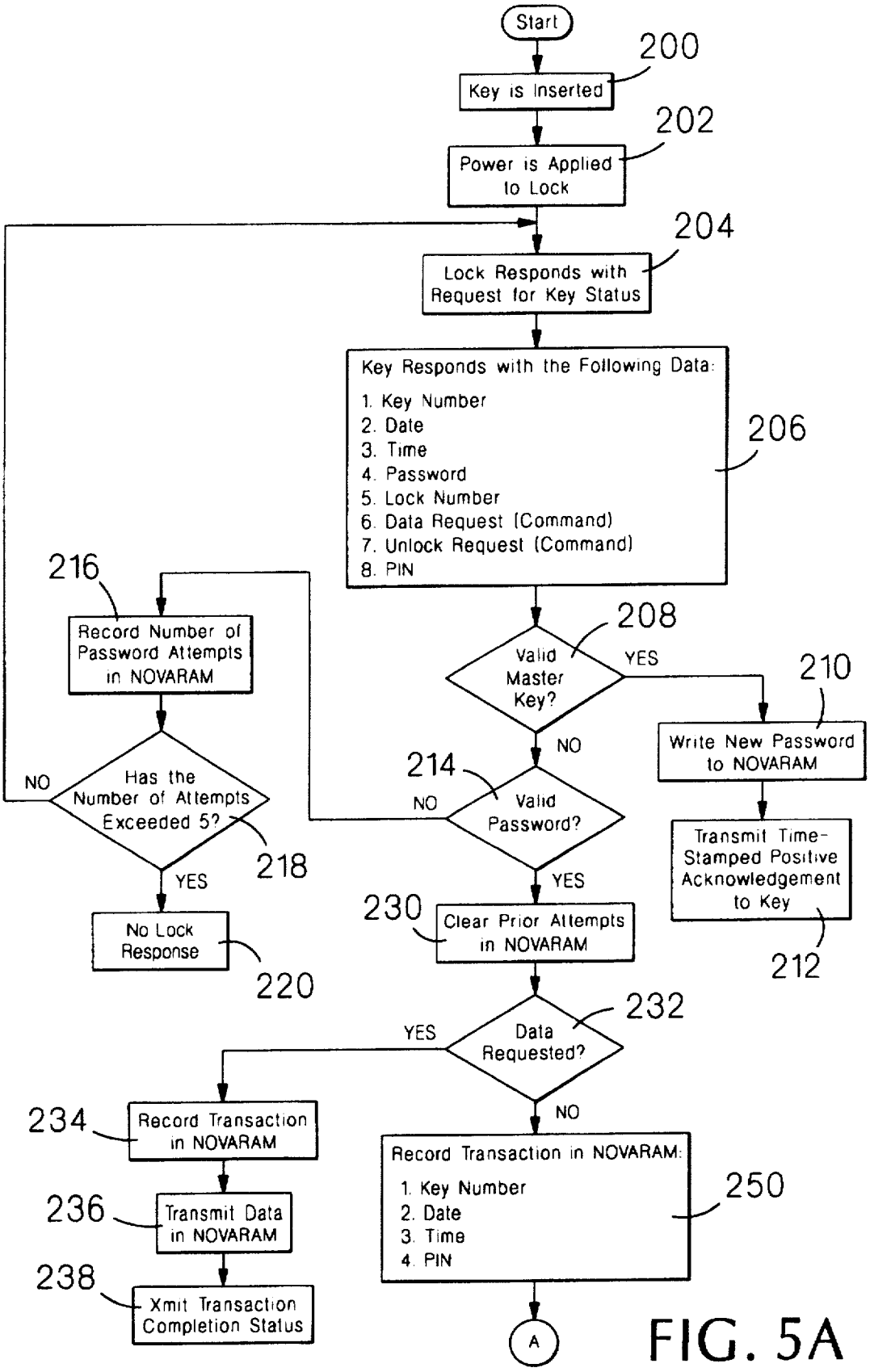
FIGS. 5A and 5B comprise a block logic diagram showing operation of the lock.
Figure 5B:
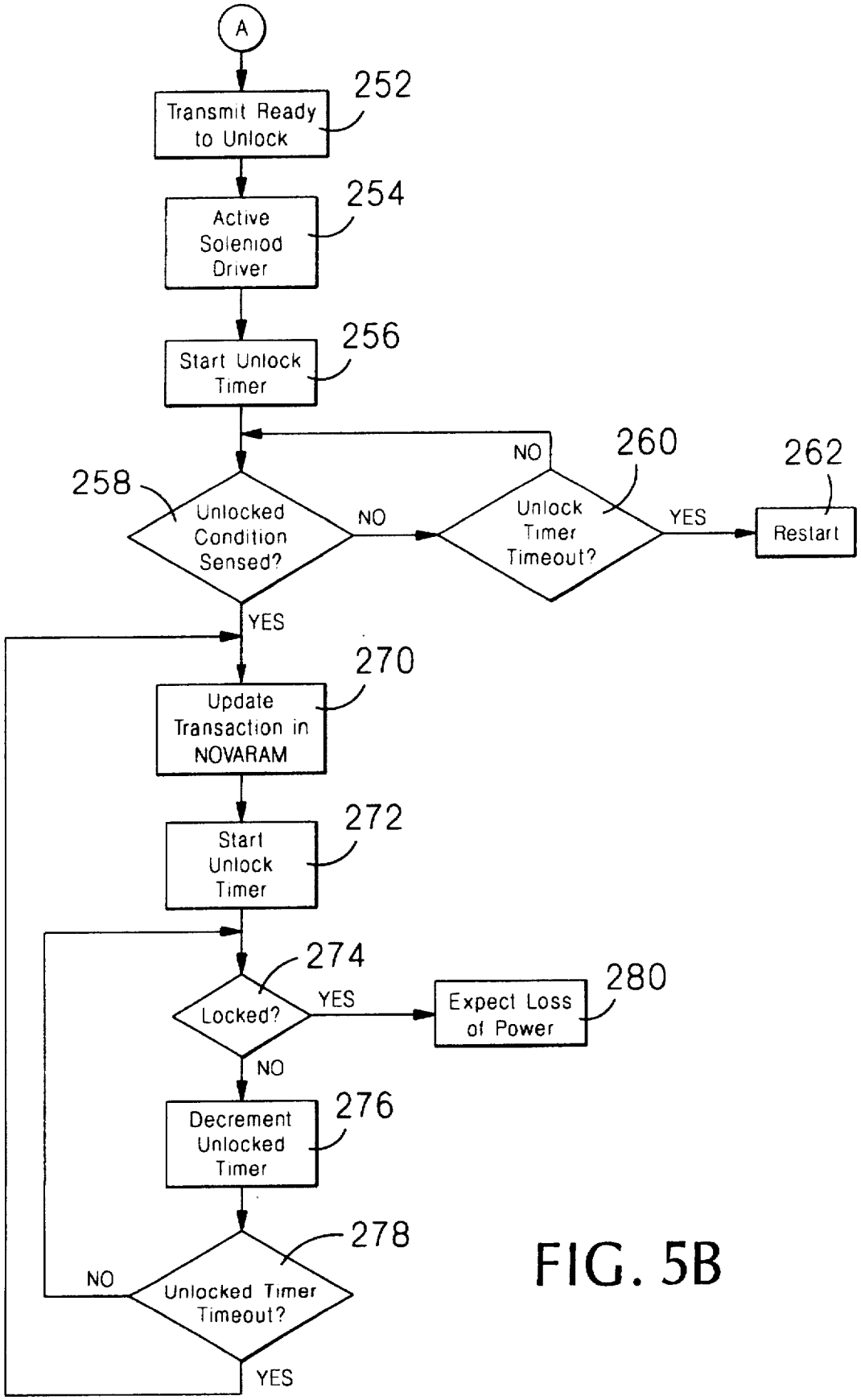

Reference should now be made to FIGS. 5A and 5B for an understanding of the method of the present invention for monitoring use of lock 10.

The present invention contemplates the use of three keys: a master key, an audit key, and a service key.

The master key is used to write a password to the memory of lock 10 or to change a previously written password. At step 200, the master key is inserted in lock 10, power is applied to the lock at step 202, the lock responds with a request for key status at step 204 and, at step 206, information is exchanged and an unlock command given by the key to the lock, all similar to the description in detail in application Ser. No. 08/395,417.

At step 208, lock 10 determines if the key is a valid master key. If yes, the new password is written to the non-volatile memory in lock 10, at step 210, and, at step 212, time-stamped positive acknowledgment is transmitted to the key.

If step 208 determines that the key is not a valid master key, that is, it is an audit key, a service key, or an unauthorized key, step 214 determines if the password given by the key is valid. If the password is not valid, step 216 records the number of password attempts in the memory of lock 10 and step 218 determines if the number of attempts has exceeded five. If the number of attempts has exceeded 5, step 220 terminates lock responses. If the number of attempts has not exceeded five, then the procedure returns to step 204. Permitting five attempts at access filters out errors due to noise, incorrect inputting of the user's PIN, and like events.

If step 214 determines that the password is valid, step 230 clears from memory the number of prior attempts with this key. Step 232 then determines if data is requested. If data is requested, that signifies that this key is an audit key and step 234 records the fact in memory. Then the data in memory as to who unlocked lock 10, when the lock was unlocked, and for how long the lock was unlocked is transmitted to the key at step 236 and step 238 transmits a transaction completion status.

If step 232 determines that data is not requested, that signifies that the key is a service key and step 250 records in memory the key number, the date, the time, and the PIN of the user. Step 252 transmits a ready to unlock signal, solenoid 80 (FIG. 1) is activated at step 254, and an unlock timer is started at step 256. Step 258 continuously senses whether there is an unlocked condition and if it is not and step 260 determines that the unlock timer has not yet reached timeout, step 258 continues to look for unlock. If timeout is reached before unlock, the unlocking procedure is aborted and step 262 requires that the unlocking procedure restart.

When step 258 senses that lock 10 is unlocked (FIG. 3B), the transaction is noted in memory at step 270 and an unlocked timer is started at 272. Step 274 continuously detects if lock 10 is locked and, if not, the unlocked timer is periodically decremented at step 276. If unlocked timer timeout is not found at step 278, the unlocked timer continues to be decremented until timeout. Then, memory is updated at step 270 and the procedure reiterated until lock 10 is locked. This particular procedure is employed to minimize the amount of memory used. A clock signal may be received from the key for use by the unlock and unlocked timers. When step 274 determines that lock 10 is locked, step 280 advises the microprocessor to expect loss of power.

When the electronic lock of the present invention is applied to vending machines, for example, it is desirable that the locking/unlocking portion of the lock have a housing which is a ¾-inch diameter DD cylinder lock barrel, the de facto standard in the vending machine industry. This is accomplished by separating the control portion of the lock from the mechanical/electromechanical elements of the lock and reconfiguring the latter elements, as is described in detail below. Consequently, the latter elements can be inserted directly into an existing ¾-inch diameter, 1.9-inch long, DD cylinder lock barrel, with only minor modifications to the cylinder lock barrel.

Figure 6:
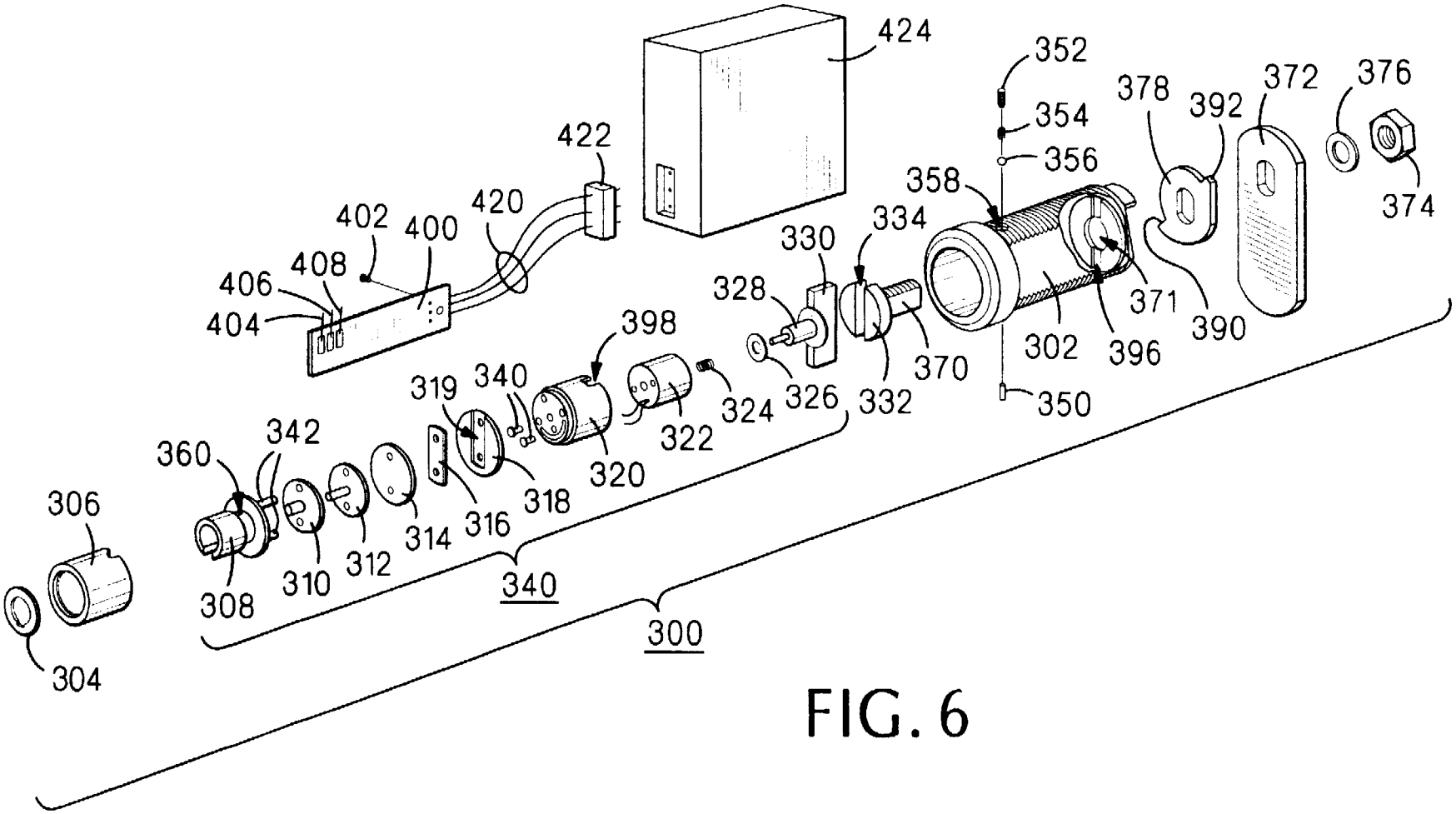
FIG. 6 is an exploded isometric view of another embodiment of an electronic lock constructed according to the present invention.

FIG. 6 illustrates an embodiment of the electronic lock described immediately above, constructed according to the present invention, and generally indicated by the reference numeral 300. Lock 300 has elements similar in function to a number of those of lock 10 (FIG. 1) and includes a housing 302 which may be the barrel of a conventional ¾-inch diameter, 1.9-inch long, DD cylinder lock. Elements of lock 300 which are inserted into housing 302 through the proximal end thereof are, in order: a tamper ring 304, a retainer 306, a front shaft 308, a front insulator 310, a communication commutator 312, a middle insulator 314, a solenoid commutator 316, a rear insulator 318 having a channel 319 defined therein into which channel the solenoid commutator fits, a solenoid housing 320, a solenoid 322, a solenoid return spring 324, a solenoid washer 326, a solenoid plunger 328 assembly having a rearwardly facing bar 330 disposed orthogonally to the major axis of housing 302, and a rear shaft 332 having defined therein a slot 334 disposed orthogonally to the major axis of housing 302 and dimensioned to accept therein bar 330.

Screws 340 secure solenoid 322 to solenoid housing 320 and pins 342 extending rearwardly from shaft 308 secure elements 310, 312, 314, 316, and 318 to solenoid housing 320 for common rotation of elements 304–328. All elements 308–328, generally indicated by the reference numeral 340, fit within retainer 306, with the rear face of the front shaft engaging the front face of rear shaft 332, but with bar 332 extending from the rear of retainer 306 as is described in detail below. An assembly pin 350 is insertable through housing 302 into retainer 306 to secure the retainer against rotation within the housing.

A key or wrench (not shown) is insertable through tamper ring 304, into retainer 306, and into a recess in front shaft 308. In this embodiment, if unlocking of lock 300 is not authorized, the key or wrench will simply rotate elements 308–328, without the breaking of any element(s) within the lock. A set screw 352, a detent spring 354, and a detent ball 356 are inserted into a threaded opening 358 defined through the wall of housing 302 such that the detent ball releasably engages a recess 360 defined in the outer periphery of front shaft 308 to provide a palpable "home" position for rotating elements 340 of lock 300.

Rear shaft 332 has a threaded DD portion 370 extending rearwardly thereof, which DD portion extends through a suitably dimensioned opening 371 in the rear wall of housing 302 for attachment of a lock bar 372 to the DD portion by means of a nut 374 and a lock washer 376. A rotating washer 378 disposed on DD portion 370 has flanges 390 and 392 extending from the periphery thereof, which flanges engage a stop 394 to terminate locking and unlocking rotation as lock 300 is locked or unlocked. Rotating washer 378 is reversible so that either 90-degree or 180-degree rotation of rotating elements 340 may be selected. A vertical slot 396 is defined in the rear wall of housing 302 extending across opening 371.

A printed circuit board 400 is attached to a flat side of housing 302 by means of a screw 402 or other suitable attachment means, with wipers 404, 406, and 408 extending through an opening (not shown) defined through the wall of housing 302. Wiper 404 slidingly engages communication commutator 312, wiper 406 slidingly engages solenoid commutator 316, and wiper 408 is a ground lead which slidingly engages solenoid housing 320. Leads 420 connect printed circuit board 400 through connector 422 to a controller 424, which controller is located remotely from housing 302.

Figure 7:
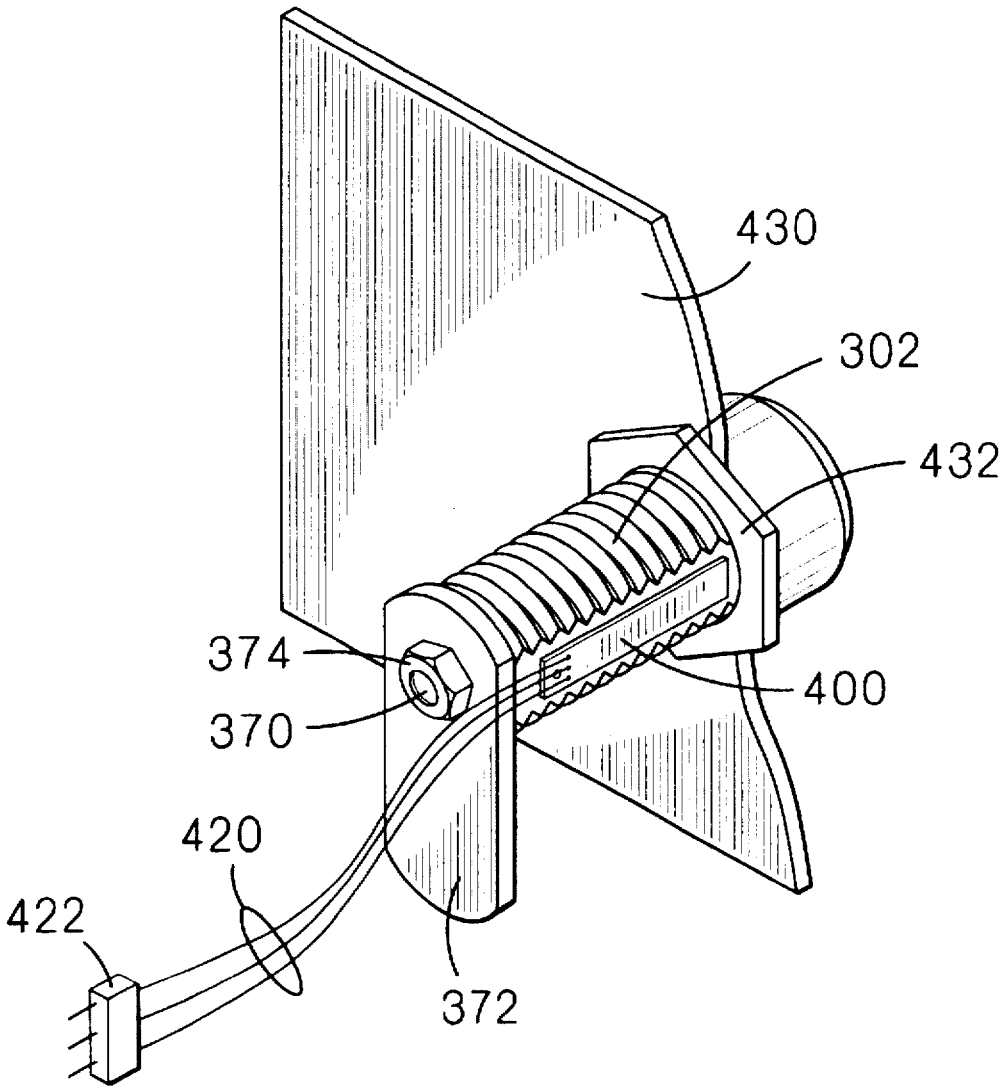
FIG. 7 is a fragmentary isometric view of the lock of FIG. 6 assembled and installed.

FIG. 7 illustrates housing 302 mounted in a panel 430 by means of a nut 432. Panel 430 may be assumed to be part of a vending machine or a similar device. It can be seen that the electromechanical elements of lock 300 consume no more volume than a conventional key-operated cylinder lock and, were it not for printed circuit board 400 and leads 420, the lock shown on FIG. 7 would appear to be a conventional key-operated cylinder lock.

Figure 8:
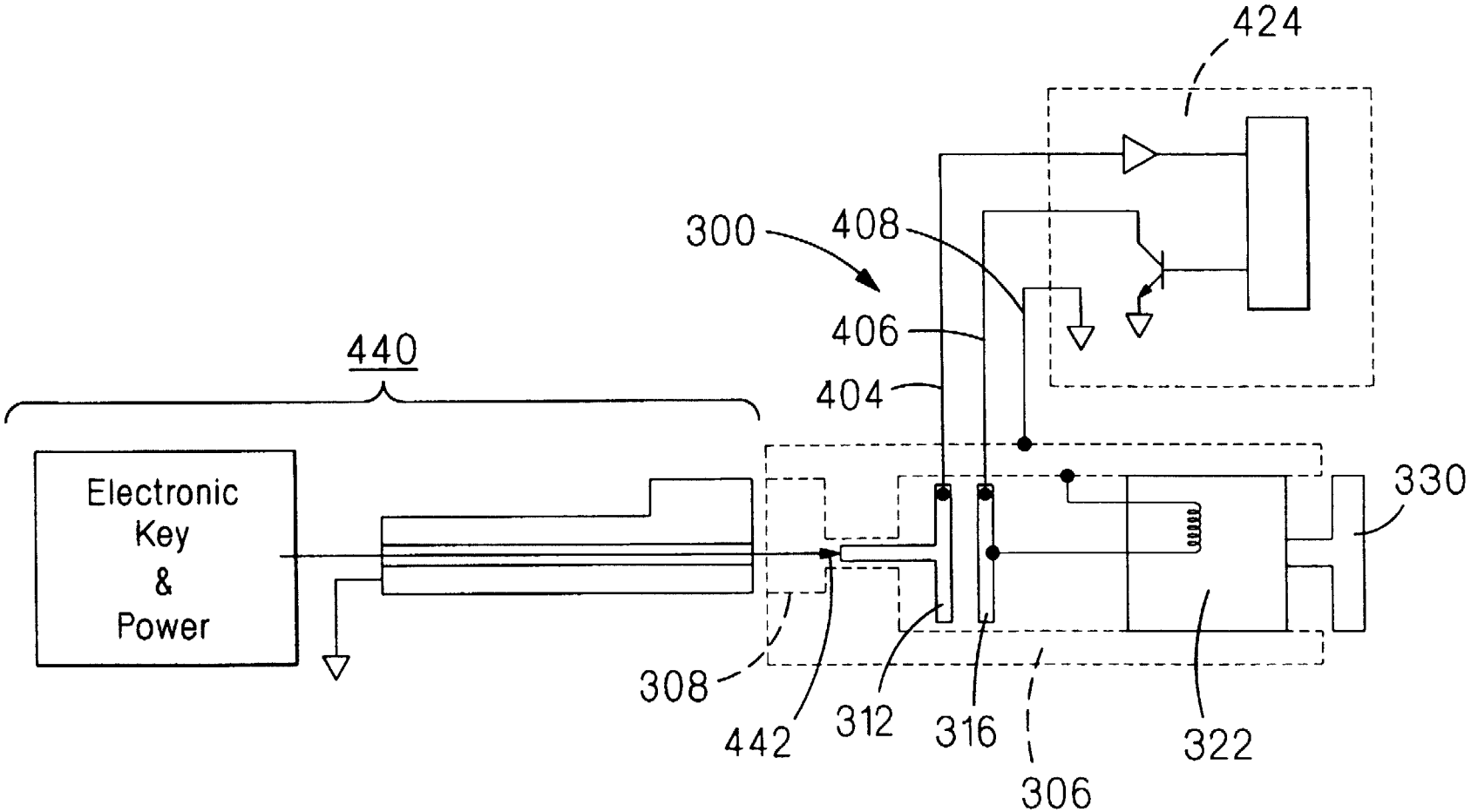
FIG. 8 is a schematic diagram illustrating the operation of the lock of FIG. 6.

In use, and with reference also to FIG. 8, the end of a key or wrench, generally indicated by the reference numeral 440, is inserted into front shaft 308 and a contact 442 in the key engages communication commutator 312. Communication protocol similar to that shown on FIGS. 5A and 5B is now followed and, if unlocking is authorized, step 254 (FIG. 5B) causes solenoid 322 to be energized which causes bar 330 extending from the rear end of retainer 306 to engage both slot 334 in rear shaft 332 and vertically aligned cutouts 398 (only the upper cutout visible on FIG. 6) defined in the rear face of solenoid housing 320. Then, any rotation of the key or wrench will rotate lock bar 372 (FIG. 6) from a locked position to an unlocked position.

FIGS. 9A, 9B, 10A, and 10B illustrate in more detail the operation of lock 300. The elements shown on these figures have been separated slightly from their normal relative positions for greater clarity.

Figure 9A:
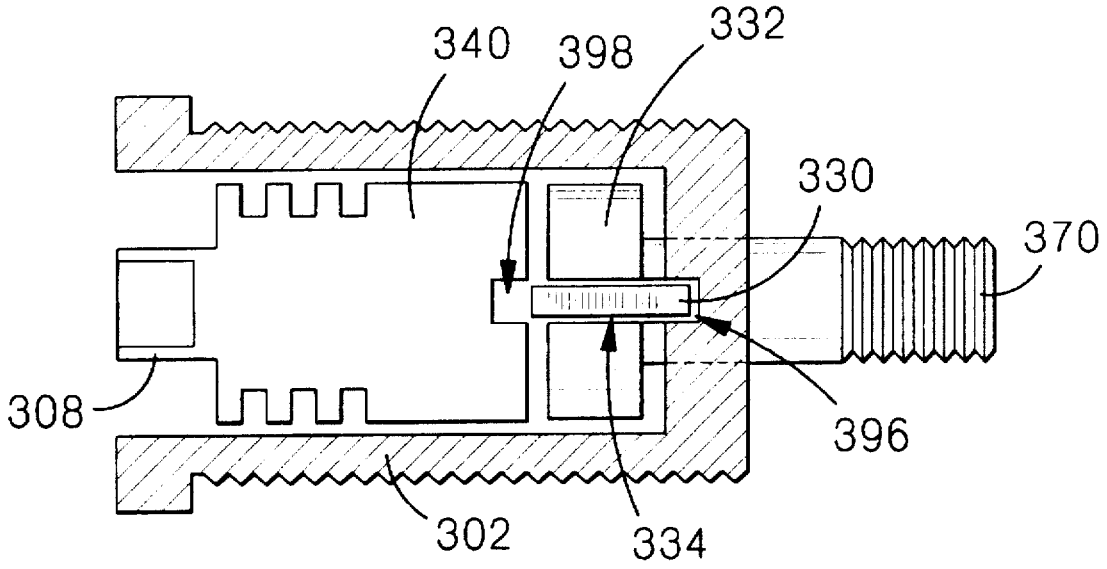
FIGS. 9A and 9B are fragmentary top plan views, in cross-section, showing elements of the lock of FIG. 6 in locked and unlock positions, respectively.

FIGS. 9A shows lock 300 in locked position. In the locked position, with solenoid 322 (FIG. 6) de-energized, solenoid spring 324 (FIG. 6) has driven bar 330 (FIGS. 9A and 10A) rearwardly, so that the bar engages both slot 334 in rear shaft 332 and channel 396 in the inside face of the rear wall of housing 302, thus preventing lock bar 372 from being rotated. On the other hand, rotating elements 340 (FIG. 9A) are free to rotate, as described above, without breaking any internal components of lock 300.

Figure 9B:
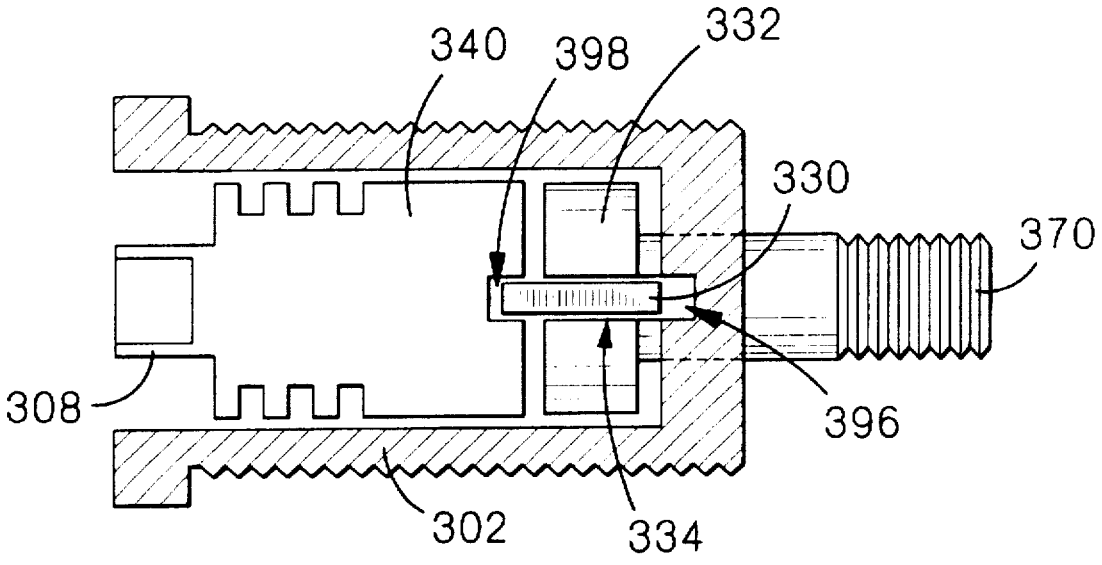

When solenoid 322 (FIG. 6) is energized, bar 330 is drawn forewardly, as shown on FIG. 9B, so that the bar engages slot 334 in rear shaft 332 and cutouts 398 in the rear face of solenoid housing 320. Now, rotation of rotating elements 340 by means of a key or wrench (not shown) inserted in front shaft 308 (FIG. 10B) and turned will permit rotation of lock bar 372 (FIG. 6) to an unlocked position.

Figure 10B:
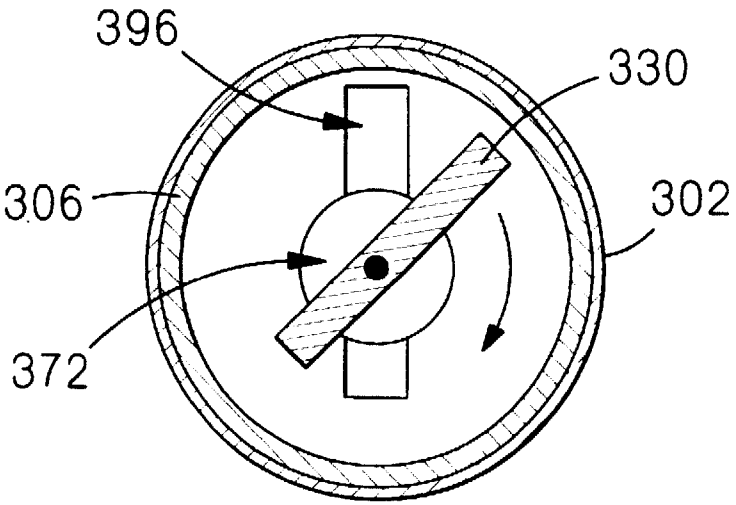
FIGS. 10A and 10B are fragmentary front elevational views, in cross-section, showing elements of the lock of FIG. 6 in locked and unlock positions, respectively.
Figure 10A:
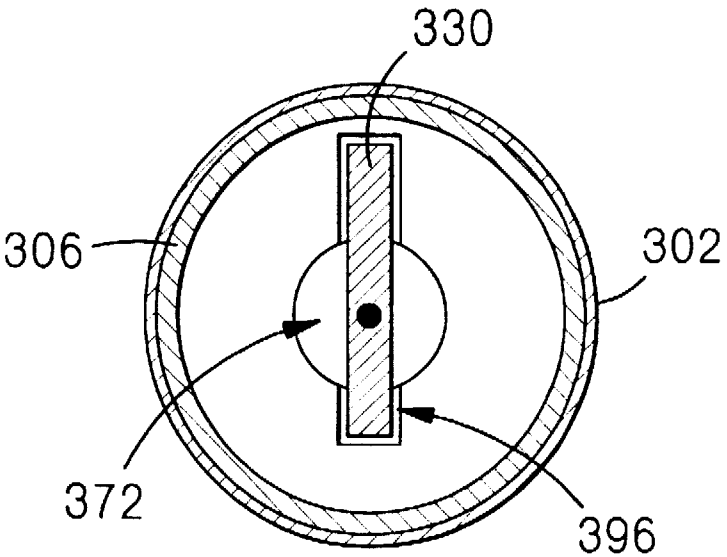

As will be understood from FIG. 6, once rotating elements 340 have been rotated about 20 degrees, wiper 406 will lose contact with solenoid commutator 316 which causes the de-energization of solenoid 322 and solenoid spring 324 will attempt to drive bar 330 rearwardly in housing 306. Such is prevented, however, as will be understood with reference to FIGS. 10A and 10B. FIG. 10A shows bar engaging channel 396, as is seen also on FIG. 9A. When, however, bar 330 is withdrawn from channel 396 (FIG. 9A) and rotated (FIG. 10B), it can no longer engage slot 396 and de-energization of solenoid 322 will simply only permit the end face of the bar to slide around the inner surface of the end wall of housing 306. The opposite ends of bar 330 and channel 396 are asymmetrical with respect to the central axis of housing 306, so that the bar cannot re-engage the channel if the bar is rotated 180 degrees.

De-energization of solenoid 322, as described above, conserves power while lock 300 is in the unlocked position and the absence of current flow to the solenoid provides an indication to controller 424 that the lock is in an unlocked position.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. An electronic cylinder lock, comprising:

(a) a generally cylindrical housing having substantially open and closed ends;

(b) a barrel member coaxial with and rotatable within said generally cylindrical housing and having receiving means defined at a first end thereof and disposed at said substantially open end for the insertion into said receiving means of key means, engagement of said receiving means and said key means permitting said barrel member to be manually rotated;

(c) shaft means coaxial with said generally cylindrical housing and extending through an opening defined through said substantially closed end, said shaft means having a head end disposed within said generally cylindrical housing and a threaded end extending externally from said substantially closed end for the attachment to a threaded end of locking/unlocking apparatus;

(d) a bar at least partially disposed within said head end such that rotation of said bar causes rotation of said shaft means, said bar being axially moveable within said generally cylindrical housing, and said bar being selectively engageable with a second end of said barrel member such that rotation of said barrel member causes rotation of said bar; and (e) means to cause said bar to be disengaged from said second end of said barrel member when said electronic cylinder lock is in a locked position and to cause said bar to be engaged with said second end of said barrel member to permit said receiving means, said barrel member, said bar, and said shaft means to rotate by rotation of said key means to permit said electronic cylinder lock to be unlocked.

2. An electronic cylinder lock, as defined in claim 1, wherein: when said electronic cylinder lock is in said locked position, said barrel member can be rotated to any degree without damage to any part of said electronic cylinder lock.

3. An electronic cylinder lock, as defined in claim 1, wherein: said means to cause comprises a solenoid disposed in said barrel member.

4. An electronic cylinder lock, as defined in claim 1, wherein: portions of said barrel member are contacted by electrical contact wires extending through openings defined through said generally cylindrical housing and connecting said portions of said barrel member with external control circuitry.

5. An electronic cylinder lock, as defined in claim 1, wherein: said generally cylindrical housing is a ¾-inch diameter by 1.9-inch long cylinder lock barrel.

* * * * *